United States Patent [19]

Sjogren

[11] 4,004,694

[45] Jan. 25, 1977

[54] EXTRACTOR ASSEMBLY FOR EXTRACTING AND/OR DIVERTING A SELECTED NUMBER OF SIGNATURES FROM A STREAM

[75] Inventor: Christer A. Sjogren, Miami, Fla.

[73] Assignee: Eds Inc., Hialeah Gardens, Fla.

[22] Filed: Oct. 2, 1975

[21] Appl. No.: 618,815

[52] U.S. Cl. ..... 209/111.7 R; 209/74 R; 271/64; 198/441; 198/570; 198/133; 198/656

[51] Int. Cl.[2] ..... B07C 5/342

[58] Field of Search ..... 209/73, 74 R, 74 M, 209/111.7 R; 271/64, 184; 93/93 HT; 198/31 R, 31 AB, 75, 35, 133, 20 T; 214/8.5 G, 8.55 S

[56] References Cited

UNITED STATES PATENTS

| | | | |
|---|---|---|---|
| 3,623,722 | 11/1971 | Sjogren | 271/64 |
| 3,754,647 | 8/1973 | DiFrank et al. | 271/64 X |
| 3,904,019 | 9/1975 | Carlen et al. | 198/31 AB |
| 3,911,800 | 10/1975 | Feldkamper | 93/93 HT |

*Primary Examiner*—Robert B. Reeves
*Assistant Examiner*—Joseph J. Rolla

[57] ABSTRACT

Signatures arranged in overlapping fashion are typically delivered from a press at high speeds (at the order of 80,000 per hour) to be stacked in bundles of a predetermined precise quantity, bundled and shipped to desired locations. During the delivery of signatures to the counting and bundling facility, typically referred to as the "mailroom," an extraction capability is provided wherein one or two signatures may be removed from the continuous stream without otherwise affecting the delivery of signatures to the stacking and bundling equipment. Alternatively, a number of copies greater than 2 may be extracted or paster copies inserted within the stream may be removed at high speed without interrupting the normal delivery of signatures to the stacking and bundling equipment. The movable elements performing the extraction operation have extremely low mass and further have a capability of moving a distance of the order of 12 inches within 75 milliseconds in order to rapidly and effectively extract the desired copies without in any way affecting the delivery of the nonextracted signatures to the stacking and bundling equipment.

20 Claims, 12 Drawing Figures

10
51a
51b
51
50a
53
56a
56b
57a
57b
52
90
89a
89
48
58a
58b
59
44
42
42'
41'
45
46
43
41
82a
94
92
91
82b
82c
82d
47
67b
67a
68
49
64a
65
66
60a'
60b'
49a
62
63
64b
60b
60a
74b
74a
73a
73b
71
69
76a
76b
77a
77b
70
72
62a
62b
61
63a
63b
25
26
40
40
34
35
36
36'
35'
34'
32
33
33'
32b
30
31
38a'
37
37
37
37

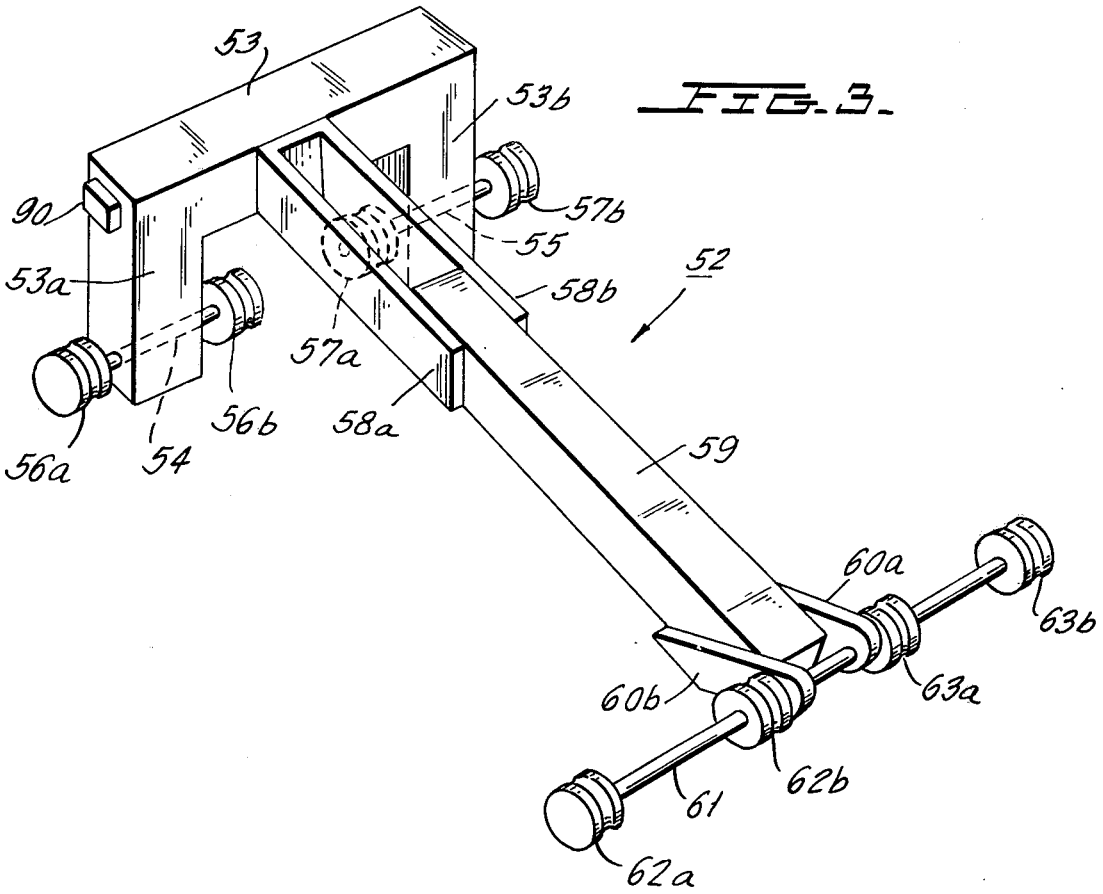
FIG. 1d.
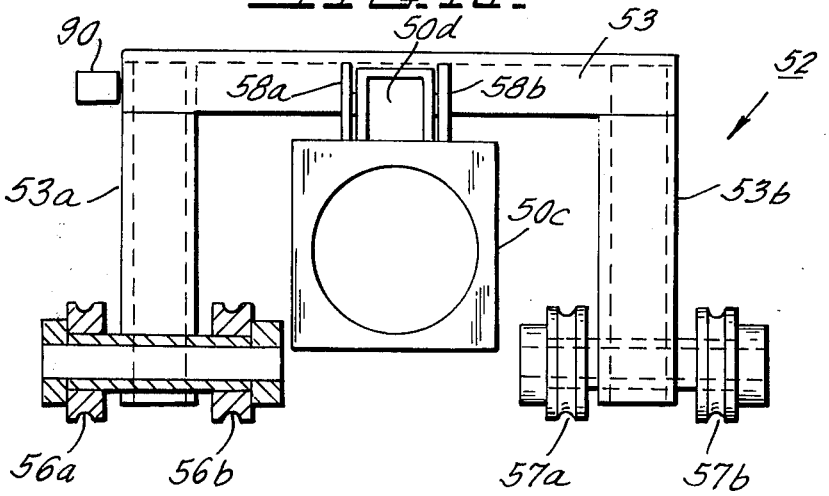

BRAKE
RETRACT
STRIKE
BALANCE
153
154
155
156
157
157a
158
159
160
140
141
142
143
ON
OFF
DOWN
UP
12"
11"
10"
9"
8"
4"
151
$t_0$
$t_1$
$t_2$
$t_3$
$t_4$
$t_5$
$t_6$
$t_7$
$t_8$
TIME
44 M SEC
60 M SEC
24 M SEC
48 M SEC
84 M SEC
76 M SEC
SLOW EXTEND

EXTRACTOR ASSEMBLY FOR EXTRACTING AND/OR DIVERTING A SELECTED NUMBER OF SIGNATURES FROM A STREAM

BACKGROUND OF THE INVENTION

Publishing or printing houses typically utilize presses and the like which are capable of producing and processing signatures at high input rates. For example, the printing of newspapers which consists of printing various pages, interleaving the pages and folding the newspaper are all operations capable of being performed at high rates of speed. Once the individual pages or sheets forming the signature are interleaved and folded, the completed signatures are typically moved in a continuous stream at speed as high as 80,000 per hour whereupon the signatures, arranged in overlapping fashion with their folded edges forward and moving in the downstream direction, are typically delivered to a "mailroom" facility having a capability of stacking the signatures into bundles of a predetermined count (such as 50, 75, or 100 per bundle, for example), and then wrapping or tying each completed bundle, whereupon the bundles are delivered to trucks and the like for distribution thereof.

There exists a number of situations in which it is desirable to be able to remove one, a few, or a small or even large predetermined number of signatures from the delivery stream.

For example, it is typically desirable to be able to periodically remove one or two signatures from the delivery stream for examination as to print quality, neatness of folding and the like.

As another example, it may be desired to divert one, several, or even a large number of signatures away from the normal delivery stream for a variety of reasons such as, for example, that the first stacking location may have experienced a malfunction or in the event that the signatures are to be handled in alternating fashion by the first and second stacking assemblies in alternating fashion.

In addition to the above, it is frequently desired to remove paster copies interspersed with otherwise acceptable signatures so as to prevent the paster copies from being erroneously delivered to the stacking and bundling apparatus. Paster copies are the result of the pasting of the end of an exhausted paper roll to the beginning of a fresh paper roll during the printing operation, whereby the pasted ends form a poor quality signature.

The type of apparatus which is necessary to perform the above-defined objectives, i.e. that of extracting one, several or a large number of signatures from a delivery stream without otherwise affecting the normal delivery of the nonextracted signatures, must be capable of intercepting the delivery stream and diverting the signatures desired to be extracted from the stream to be removed from the delivery stream at an extremely high rate of speed so as not to divert any signatures which are to undergo normal delivery along the main or non-diverted delivery path.

One conventional apparatus for achieving this is described in copending application Ser. No. 398,072 filed Sept. 17, 1973, now U.S. Pat. No. 3,904,019.

In this apparatus, the signature stream is moved along a delivery path having a slight bend so that the spine of each signature is caused to be lifted a small predetermined distance away from the engaging top surface of the preceeding adjacent downstream signature to form a gap between the lifted spine and the top surface of the preceeding adjacent downstream signature. During normal operation, the signatures normally move over the bend in the delivery path and pass along delivery belts to the desired location which may, for example, be stacking and wrapping or tying apparatus, there being no interference with the delivery of signatures thereto. In order to extract one, several or a large number of signatures, a reciprocally movable shunting device comprised of a carriage supporting a pair of cooperating closed loop belt assemblies is moved substantially diagonally downward toward the region of the aforesaid bend in the normal delivery path so that the forward end, or nose, of one of said closed loop conveyor belt assemblies enters into the region of the gap formed between the folded edge, or spine, of a signature approaching the bend and the next adjacent downstream signature which has passed the bend in the normal delivery path by an amount sufficient to cause its spine and an intermediate portion of the downstream signature to assume a curvature following the delivery path. Thus the signature whose spine is just beginning to pass over the bend is diverted and is caused to move upwardly between the pair of cooperating conveyer belt assemblies until it is at least partially captured therebetween. As soon as the signature (or signatures) has (have) been captured between the cooperating conveyor belts, the reciprocating assembly moves upwardly at a rapid rate so that the movement of signatures between the cooperating conveyor belt assemblies, together with the diagonally upward movement of the conveyor belt assembly carriage causes the extracted signatures to rapidly move diagonally upward and away from the normal delivery path, allowing upstream signatures in the main path to continue their normal delivery path without any interruption whatsoever.

The major drawback in the above-mentioned structure resides in the fact that the assembly which reciprocally moves the pair of closed loop conveyor belt assemblies respectively into and out of the intercept position has a substantially large mass which, in the embodiment taught in the above-mentioned U.S. Pat. No. 3,904,019, is in excess of 100 pounds. Since the assembly is accelerated from a standstill position into the intercept position and is then abruptly moved from the intercept position to the withdrawn position, the large amount of mass which must be moved in order to accomplish the extraction operation for as few as one signature results in a necessarily sluggish apparatus which is incapable of performing extraction of as few as one signature from a stream of delivery signatures operating at very high rates of speed, or alternatively, one which requires extremely large driving forces.

BRIEF DESCRIPTION OF THE INVENTION

The present invention is characterized by providing the desired extraction and/or stream diverting capability at extremely high rates of speed so as to be capable of extracting as few as one signature from a main delivery stream of signatures even in applications where the delivery rate in the normal delivery stream is as high as 80,000 signatures per hour or greater.

The extractor arrangement of the present invention is comprised of a first stationary closed loop conveyor belt assembly which is continuously operated and which has its lower end positioned a spaced distance above the normal delivery stream so as not to in any way interfere with the delivery of signatures along the normal or main path. Piston means are provided for reciprocally moving the upper and lower ends of a second closed loop conveyor belt assembly cooperating with the first closed loop conveyor belt assembly so as to have an upper run substantially in engagement with a lower run of the first stationary closed loop conveyor assembly. In normal operation, i.e. when no extraction operation is desired, the upper and lower ends of the second (movable) closed loop conveyor assembly are moved to a position so that the lower end thereof is positioned well above the normal or main delivery path so as not to interfere with the delivery of signatures therealong. A plurality of roller assemblies are provided at the upper and lower ends, which assemblies are mounted to carriage means movable by a reciprocating piston assembly designed to simultaneously move the upper and lower roller assemblies either downwardly toward an intercept position or upwardly and away from an intercept position. Intermediate roller means are provided between the upper and lower roller assemblies to maintain proper tension in the conveyor belts of the second (movable) conveyor assembly entrained about the aforementioned rollers.

When an extraction operation is desired, the piston assembly is activated to drive the carriage, and hence the upper and lower roller assemblies downward so that the lower roller assembly moves toward a bend arranged in the normal conveyor path so as to ultimately move the lower roller assemblies into the gap region between an adjacent pair of signatures (hereinafter referred to as the "intercept" position). The movable conveyor assembly remains in the intercept position for a period of time sufficient to extract one, two, several, or a small or large predetermined number of signatures. When the desired number of signatures to be extracted has been reached, the piston assembly drives the movable conveyor assembly diagonally upwards and away from the intercept position at a speed sufficient to remove the lower end of the movable conveyor assembly out of the intercept location, so as not to interfere with the normal delivery of those upstream signatures which are desired to be moved along the main delivery path. Due to the significantly reduced mass of the movable conveyor assembly, and further due to the fact that the movable conveyor assembly belts and the belts of the stationary first conveyor assembly cooperating therewith move at a linear speed which is of the order of three times the speed of movement of signatures passing along the normal delivery path, the extracted signatures are thereby rapidly removed from the normal delivery path so as to have substantially no effect whatsoever upon those upstream signatures which are to be moved along the main delivery path.

The significantly reduced mass of the second (movable) conveyor assembly enables this conveyor assembly to be moved in either direction through a distance of the order of one foot in less than 75 milliseconds or, in other words, being capable of driving the movable conveyor assembly at a velocity of the order of 160 inches per second, or 13 feet per second, enabling the rapid extraction of as few as one signature without interfering with the normal flow of unextracted signatures along the main delivery path.

Highly accurate timing of the extraction operation is obtained by activating first and second counter means under control of signature sensor means to precisely track the signature to be extracted. When the first counter reached a predetermined count, the piston is activated to move the movable conveyor assembly into the intercept position. When the second counter achieves the predetermined count plus a count of pulses equal to a predetermined additional travel distance (typically of the order of three inches), the piston assembly is again activated to withdraw the movable conveyor assembly from the intercept position whereby the single signature to be extracted is moved between the first and second conveyor assembly at a velocity of the order of three times the velocity of signatures moving along the main path so as to rapidly remove the extracted signature from the main delivery path without interfering with the delivery of the signatures along said main path.

The extractor assembly utilizes a novel piston assembly comprising an elongated substantially cyclindrical housing having a reciprocating piston mounted therein so as to define first and second chambers on opposite sides of the piston. An elongated axially aligned opening extends along the length of the cylindrical housing and the reciprocating piston is provided with a radially aligned projection extending through said opening. Novel sealing means cooperates with the piston and its projection to provide a "sliding seal" which maintains the piston chamber airtight throughout its reciprocating operation.

A carriage is secured to the piston projection and is provided with roller assemblies at its upper and lower ends which constitute the upper and lower ends of the second (movable) conveyor assembly. Resilient O-ring belts are entrained about the upper and lower roller assemblies, and a plurality of stationary mounted freewheeling roller assemblies are also rollingly engaged by the resilient O-ring belts to maintain the O-ring belts under proper tension during their reciprocating action.

The first (stationary) and second (movable) conveyor belt assemblies are both positively driven so that their adjacent engaging belt runs cooperate to receive a signature therebetween and urge the signature substantially upward between the adjacent runs at a velocity of the order of three times that of the velocity of signatures moving along the main delivery path so as to perform rapid extraction of one or more signatures.

As was described hereinabove, the elements moved by the reciprocating piston assembly are of significantly reduced weight to enable the elements to be rapidly accelerated into and away from the intercept position in order to extract as few as one signature from a continuous stream of signatures arranged in overlapping fashion without in any way interfering with the normal flow of signatures along the main delivery path.

A light sensor mounted a predetermined distance upstream from the "bend" in the main delivery path, is adapted to sense the presence of reflective tape placed upon signatures (typically "paster" copies) to be extracted in order to activate the aforesaid counter for performing an extraction operation.

The extractor apparatus employs a speed sensor to generate pulses representative of the delivery speed of signatures in the main path to increment the aforesaid counters and thereby provide an extractor apparatus which serves to directly relate the time required to extract signatures with the velocity of the main delivery path.

BRIEF DESCRIPTION OF THE FIGURES AND OBJECTS

It is therefore one object of the present invention to provide novel high speed means for extracting one or more signatures from a stream of signatures arranged in overlapping fashion and moving along a main delivery path without in any way interfering with the normal flow of signatures along said main delivery path.

Still another object of the present invention is to provide novel movable means comprised of a conveyor belt assembly which may rapidly be moved into an intercept position so as to extract one or more signatures from a continuous stream of signatures arranged in overlapping fashion and moving along the main delivery path wherein the movable conveyor belt assembly is of significantly reduced mass so as to enable rapid acceleration of the movable conveyor assembly into and away from the intercept position.

Still another object of the present invention is to provide electronic control means for the aforesaid movable conveyor assembly which is adapted to precisely activate the movable conveyor belt assembly to relate the extraction time to stream velocity and thereby assure proper extraction of as few as a single signature from the main delivery path without interfering with the otherwise normal flow of signatures along the main delivery path.

The above as well as other objects of the present invention will become apparent when reading the accompanying description and drawings in which:

FIG. 1*a* shows an elevational view of a novel extractor embodying the principles of the present invention;

FIG. 1*b* is a top plan view of the extractor of FIG. 1*a;*

FIG. 1*c* shows a view of the lower end pulley and belt arrangement of the extractor looking in the direction of arrows 1*c*—1*c* of FIG. 1*a;*

FIG. 1*d* shows a view of the upper portion of the movable pulley assembly carriage and upper rollers looking in the direction of arrows 1*d*—1*d* of FIG. 1*a;*

FIG. 1*e* shows a detailed view of the portion of the main delivery path looking in the direction of arrows 1*e*—1*e* in FIG. 1;

FIG. 2*a* shows another simplified elevational view of the assembly of FIG. 1*a;*

FIG. 2*b* shows a sectional view of one of the roller assemblies in the extractor in FIG. 2*a* looking in the direction of arrows 2*b*—2*b;*

FIG. 2*c* shows a sectional view of the upper roller assembly for the stationary conveyor employed in the extractor looking in the direction of arrows 2*c*—2*c* of FIG. 2*a;*

FIG. 3 shows a perspective view of the carriage assembly for the movable conveyor employed in the extractor of FIG. 1*a;*

FIG. 5 shows a block diagram of the electronic control circuitry employed in the extractor of FIG. 1*a;* and FIG. 6 shows a plot of curves useful in explaining the operation of the extractor of the present invention.

DETAILED DESCRIPTION OF THE INVENTION

Figure 1B:
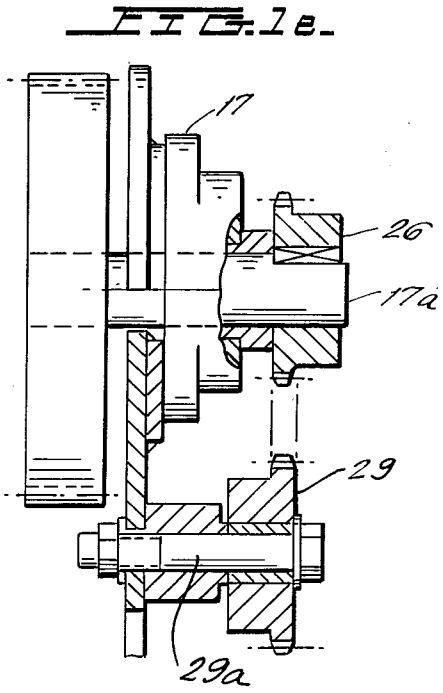

Making initial reference to FIGS. 1*a*–1*e* there is shown therein an extractor assembly 10 designed in accordance with the principles of the present invention and which cooperates with the main delivery apparatus 11.

The main delivery apparatus comprises a conveyor assembly which receives signatures preferably fed in a continuous stream in overlapping fashion with the folded edges, or spines, of the signatures being oriented in the forward feed direction. For example, note the signatures S moving along the first belt portion 12 wherein the folded edges, or spines F of the signatures are arranged so as to move in the feed direction represented by arrow 13. The signatures are moved between the upper run of conveyor belts 12 entrained at their right hand ends about pulleys 13 and the lower run of belts 39 entrained about pulleys 38. Only a few signatures have been shown at the right-hand end of FIG. 1*a* for purposes of simplicity, it being understood that a continuous stream of signatures arranged in the overlapping manner are normally fed along these conveyor belts. The rollers 13, 38, etc. are in actuality a plurality of rollers, alternating ones of which receive a first plurality of O-ring type belts (belts 12, for example) entrained therearound. The remaining interspersed rollers are adapted to receive conveyor belts (14, for example) entrained therearound and further entrained about rollers 15, 16 and 17, which rollers are mounted freewheelingly rotate about suitable shafts provided therefore.

Rollers 15 and 16 are arranged in such a fashion as to form a "bend" in the delivery path which occurs just downstream of the roller 16. The signatures follow this bend so as to move downwardly off roller 16 and onto the upper run of conveyor belts 14, which run extends between rollers 15 and rollers 17. It can be seen that, as the signatures move downwardly off roller 16, a slight gap G is formed between the upper surface $S_1$ of the downstream signature S′ and the leading edge F′ of the next adjacent upstream signature S″. The purpose of gap G will be described in detail hereinbelow.

It should be understood that the rollers 17 are in actuality a plurality of rollers mounted upon a common shaft 17*a* wherein alternating rollers are adapted to receive belts 14 in grooves provided therefor and while the remaining interspersed rollers 17 and a cooperating group of rollers 19 rotatable about a common shaft 19*a* receive belts 18.

Thus the main delivery path can be seen to be comprised of the upper runs of belts 12, 14 and 18, and the lower runs of belts 39, 37 and 20 which are adapted to move a continuous stream of signatures arranged in overlapping fashion with the folded edges F oriented in the feed direction. During movement along the main delivery path, the signatures move about a bend in the main delivery path defined by rollers 16, causing the signatures to move downwardly as they pass over the upper run of belts 14 and between rollers 13 and 16 and onto the upper run of belt 14 extending between rollers 15 and 17. Under normal circumstances, i.e., when no signatures are to be extracted, the signatures continue to move along the run of belts 14 extending between rollers 15 and 17 and then onto the upper run of belts 18 extending between rollers 17 and 19. The closed loop O-ring belts 20 entrained about small diameter rollers 21 and large diameter rollers 22 are adapted to define a tapered throat portion between the lower run of belts 20 and the upper run of belts 18, causing signatures entering between these runs to experience compression which is provided for the purpose of squeezing out air captured within the pages of the signatures and between adjacent signatures, which air may have been introduced therein as a result of the signatures moving about the bend in the main delivery path formed by rollers 16. The squeezing of the air from between and among the signatures serves to facilitate subsequent handling thereof.

As was previously described, rollers 19, which are mounted upon common shaft 19*a* are locked to shaft 19*a* so as to rotate therewith. A gear 23 is mounted to one end of shaft 19*a* and hence the rollers 19. A magnetic sensor 24 is positioned immediately adjacent the periphery of gear 23 and serves to generate a pulse as each tooth of the gear passes a magnetic sensor for performing a counting function as will be more fully described hereinbelow. The movement of each tooth in gear 23 represents a movement of the belts and hence the signatures, over a linear distance of 0.20 inches.

The conveyors in the main delivery path are adapted to move the signatures at a rate which is compatible with the delivery of signatures thereto, typically from the press room, which delivery rate may be of the order of 80,000 per hour, or greater. Obviously, the delivery path shown along the lower portion of FIG. 1*a* is designed to have its feed rate adjusted in accordance with the delivery rate from the press room.

Figure 1A:
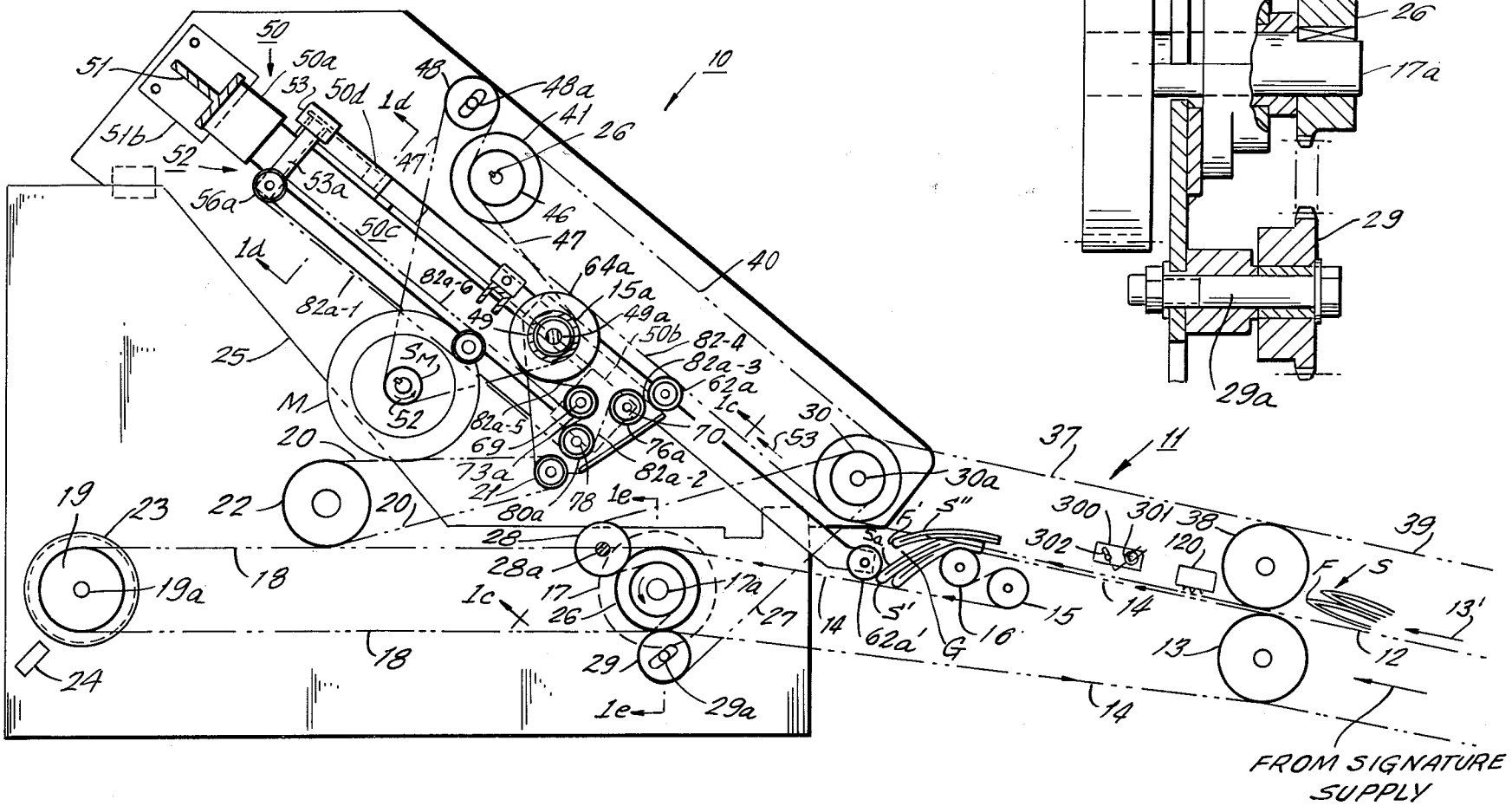
Figure 1B:
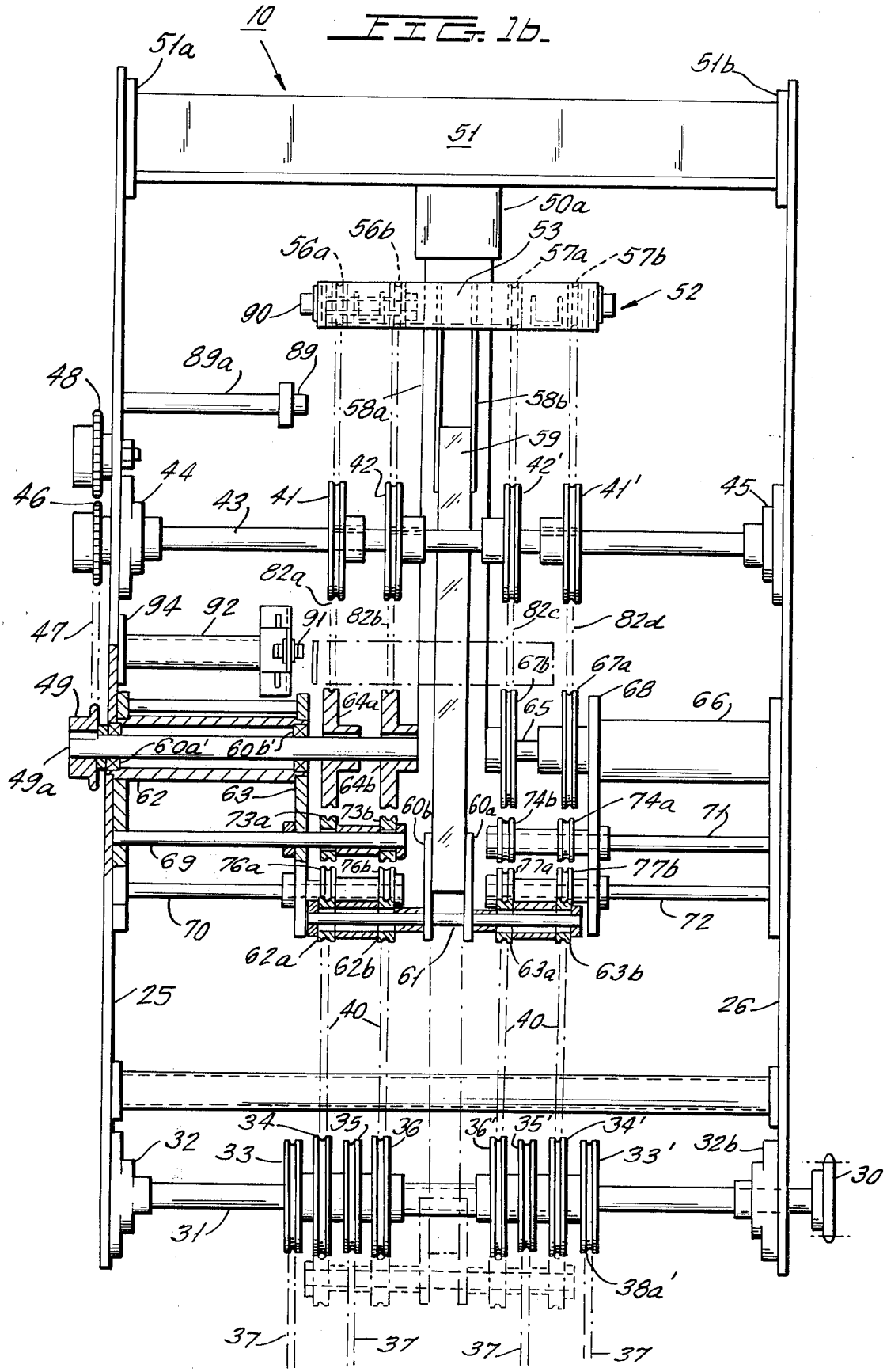

The extractor assembly 10 of FIG. 1*a* is comprised of a pair of side plates 25 and 26 suitably secured to supporting frames (not shown for purposes of simplicity) for the conveyor belts and rollers of the main conveyor section 11 which constitute the main delivery path.

The rollers 17 about which the delivery belts 14 are entrained are mounted on common shaft 17*a* so as to drive shaft 17*a* by the rotation of those rollers 17 which are adapted to receive the conveyor belts 14. The interspersed rollers of the roller group 17 which are adapted to receive belts 18 are freewheeling mounted on shaft 17*a*. Hence shaft 17*a* rotates with the rotation of those rollers which receive and support the belts 14. Attached to shaft 17*a* is a sprocket 26 which meshes with a chain 27 which, as can best be seen from FIG. 1*a*, further meshes with the teeth of sprockets 28, 29 and 30. Sprocket 28 is mounted to rotate about stationary shaft 28*a*. Sprocket 30 is mounted to rotate with stationary shaft 30*a*. Sprocket 29 is rotatably mounted upon shaft 29*a* which is adjustable in order to maintain appropriate tension in chain 27.

Sprocket 30 is also shown in FIG. 1*b* and is rigidly secured to one end of shaft 31 which is mounted to freewheelingly rotate within supports 25 and 26 by means of bearings 32*a* and 32*b*.

A plurality of pulleys 33–36 and 33′–36′ are mounted on shaft 31. Pulleys 33, 35 and 33′, 35′ are locked to rotate with shaft 31 so as to receive and support the O-ring belts 37 which are entrained about the aforementioned rollers and interspersed ones of the rollers 38 arranged above the rollers 13 and aligned with rollers 33, 35, 33′, 35′ whereby the lower run of belts 37 and the confronting upper run of belts 14 define a delivery path for the signatures moving therebetween. As was described hereinabove, alternating ones of the rollers 38 have entrained therearound O-ring belts 39 to define a second delivery path portion extending between the upper run of belts 12 and the lower run of belts 39.

The pulleys 34, 36, and 34′, 36′ are freewheelingly mounted upon shaft 31 so as to rotate under control of drive sprocket 46, to be more fully described. The lower ends of O-ring belts 40 are entrained about these rollers and are further entrained about the rollers 41, 42 and 41′, 42′ mounted to rotate with common shaft 43 and which shaft is freewheelingly mounted relative to the end support plates 25 and 26 as provided for by bearings 44 and 45.

The pulleys 34, 36 and 34′, 36′ and 41, 42 and 41′, 42′ and the associated closed loop O-ring belts 40 define the stationary conveyor assembly of the extractor which functions in a manner to be more fully described. The drive imparted to pulleys 41, 42 and 41′, 42′ (by sprocket 46) causes the lower run of belts 40 extending between the aforementioned pulleys and the lower pulleys 34, 36 and 34′, 36′ to move at a rate which is of the order of three times the linear rate of the conveyor belts in the main delivery path to facilitate rapid extraction of signatures as will be more fully described hereinbelow.

The pulleys 41, 42 and 41′,42′ are all locked to common shaft 43 whose left end, as shown in FIG. 1*b*, is provided with a sprocket 46 for meshing with chain 47. Chain 47 meshes with sprocket 46 as well as tension maintaining sprocket 48, motor drive sprocket $S_M$ and movable conveyor drive sprocket 49.

The movable and stationary conveyor assemblies of the extractor 10 are operated by motor M whose output shaft has drive sprocket $S_M$ secured thereto. Drive is imparted from motor M to the movable and stationary conveyor assemblies through the chain 47 which meshes with sprockets $S_M$, 49, 46 and 48. Sprocket 48 is adjustably mounted about shaft 48*a* so as to maintain appropriate tension in the drive chain 47.

Sprocket $S_M$ rotates in the counterclockwise direction as shown by arrow 52 of FIG. 1*a* in order to move the lower run of the stationary conveyor assembly defined by belts 40 in the direction shown by arrow 53 of FIG. 1*a*. The cooperating run of the belts in the movable conveyor assembly also moves in the same direction as shown by arrow 53, which movable conveyor assembly will be more fully described hereinbelow.

The movable conveyor assembly is comprised of a piston drive assembly 50 whose upper end 50*a* is secured to one surface of an elongated and substantially T-shaped mounting bracket 51 and intermediate the ends thereof which ends, in turn, are secured to the side frames 25 and 26 by mounting plates 51*a* and 51*b*. Although not shown for purposes of simplicity, the opposite end 50*b* of the piston assembly 50 is suitably secured to the machine framework.

The intermediate hollow cylindrical portion 50*c* comprises a hollow air cylinder provided with an internally mounted piston P (see FIG. 4) having a projection 50*d* extending radially outward and through an elongated slot (not shown) in cylinder 50*c* for securement to a movable carriage assembly as will be more fully described. The aforementioned axially aligned elongated slot is provided with a sliding, air-tight seal movable over substantially the entire length of the cylinder 50*c* which sliding seal is adapted to prevent the escape of air under pressure, introduced into the assembly to move the piston in a reciprocating fashion between its extreme upper and lower limits of travel. Piston assembly 50 is mounted in a stationary fashion while the piston mounted therein and its projection 50*d*, move between the aforementioned end points. The air cylinder employed herein is preferably an Origa cylinder manufactured by Origa Cylinder AB of Sweden. The upper and lower ends 50*a* and 50*b* are each provided with ports (to be more fully described) wherein ports at each end are provided for admitting air under pressure into the cylinder driving the piston between its extreme end points. An additional port (to be more fully described) is preferably provided at the lower end 50b for permitting rapid egress of air from the hollow interior of the piston assembly to permit more rapid movement of the piston, as will be more fully described.

The piston is utilized to drive a carriage assembly 52 also shown in FIG. 3. Carriage assembly 53 is comprised of an upper, substantially U-shaped portion 53 having downwardly depending arms 53a and 53b (not also FIG. 1d). The bottom ends of these arms are each provided with openings for receiving shafts 54 and 55 which are adapted to freewheelingly support pulleys 56a, 56b and 57a, 57b, which pulleys are provided with grooved peripheries for receiving and supporting O-ring type belts to be more fully described.

The carriage assembly is further comprised of a pair of plates 58a and 58b arranged in spaced parallel fashion, which plates are secured to U-shaped member 53 and to piston projection 50d at their intermediate portions projection 50d being arranged between these plates, and are secured to an elongated substantially rectangular shaped bar 59, such as, for example, by welding.

The lower end of bar 59 is provided with a pair of support brackets 60a and 60b preferably welded to bar 59 and whose outer free ends are provided with openings for receiving and securing shaft 61. Two pairs of pulleys 62a, 62b and 63a, 63b are freewheelingly mounted to shaft 61. Each of the pulleys 62a, 62b and 63a, 63b are provided with grooved peripheries and are respectively aligned with the pulleys 56a, 56b and 57a, 57b to receive and support O-ring belts 82a–82d to be more fully described, which constitute the conveyor belts of the movable conveyor assembly.

The drive means for the movable conveyor assembly is comprised of the above-mentioned sprocket 49 (see FIG. 1b) which is locked to shaft 49a, which shaft is freewheelingly mounted within an opening in plate 25 by bearing 60a. The opposite end of shaft 49a is freewheelingly mounted within bearing 60b secured within hollow cylinder 62 whose first end is secured to end plate 25 and whose opposite end is secured to a support plate 63.

The free end of shaft 49a extends beyond bearing 60b and has a pair of pulleys 64a, 64b locked thereto. The pulleys have grooved peripheries and are aligned with pulleys 56a, 56b and pulleys 62a, 62b for receiving and supporting the O-ring belts 82a, 82b constituting the movable conveyor assembly.

A similar pulley structure is mounted to side plate 26 and is comprised of a shaft 65 also freewheelingly mounted between hollow cylinder 66 and end plate 26 by suitable bearings (not shown for purposes of simplicity) so as to freewheelingly mount shaft 65. The free inner end of shaft 65 has locked thereto a pair of pulleys 67a, 67b having grooved peripheries and being respectively aligned with pulleys 57a, 57b and 63a, 63b for receiving and supporting the aforementioned O-ring belts constituting the movable conveyor assembly.

Cylinder 66 further supports a mounting plate 68 similar to the mounting plate 63. Plates 63 and 68 cooperate with side plates 25 and 26 to support first, second and third pairs of shafts 69–70, 71–72 and 78–79 respectively (see also FIG. 1c). Shafts 69 and 71 are each rigidly secured between plates 25, 63 and 26, 68 respectively, and are each provided with a pair of pulleys 73a, 73b and 74a, 74b having grooved peripheries and aligned with pulleys 64a, 64b and 67a, 67b for receiving and supporting the O-ring belts of the movable conveyor assembly as will be more fully described.

Plates 25, 63 and 26, 68 further support shafts 70 and 72 which are locked to these plates and which have their free inner ends adapted to freewheelingly support the roller pairs 76a, 76b and 77a, 77b, which pulleys are grooved around their peripheries and aligned, for example, with the pulleys 73a, 73b, 74a and 74b to receive the O-ring belts of the movable conveyor assembly to be more fully described.

Figure 1C:
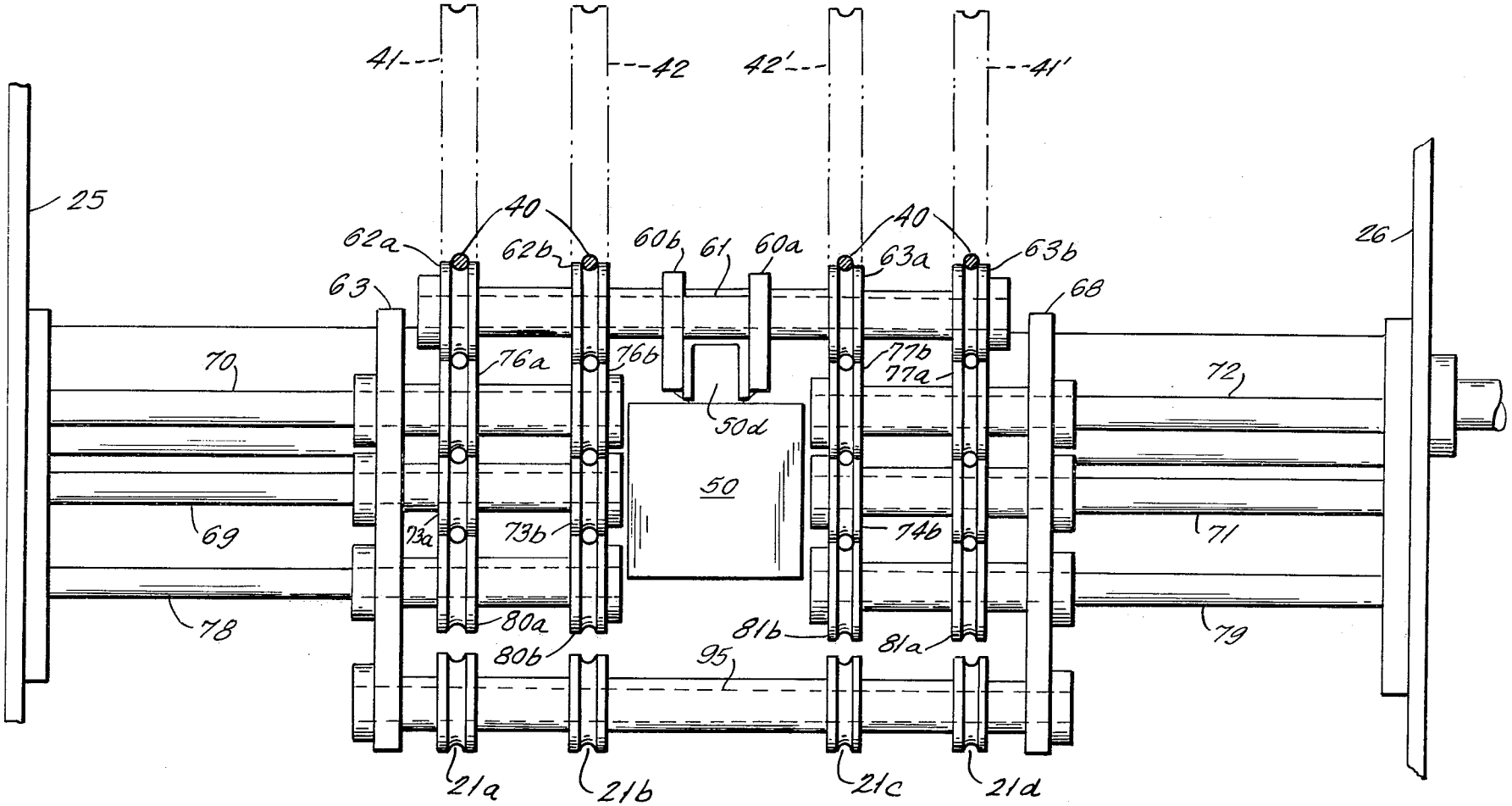

As shown best in FIG. 1c, still another pair of shafts 78 and 79 are secured between brackets 25, 63 and 26, 68 and are also respectively provided at their inner ends with a pair of rollers 80a, 80b and 81a, 81b which are freewheelingly mounted upon shafts 78 and 79 and which are aligned, for example, with rollers 76a, 76b and 77a, 77b to receive the O-ring conveyor belts of the movable conveyor assembly.

The movable conveyor assembly is provided with four resilient O-ring conveyor belts 82a, 82b, 82c and 82d. As shown best in FIG. 1a and, considering belt 82a; a first run 82a-1 extends between pulleys 56a and 80a; run 82a-2 extends between pulleys 80a and 76a; run 82a-3 extends between pulleys 76a and 62a; run 82a-4 extends between pulleys 62a and 64a; run 82a-5 between pulleys 64a and 73a; and run 82a-6 between pulleys 73a and 56a. The carriage assembly and movable conveyor belts as described hereinabove are shown with the carriage assembly in the uppermost position. As will be noted, the pulleys 64a, 80a and 76a, while being freewheelingly mounted, experience no linear reciprocating movement. However, pulleys 56a and 62a, which are freewheelingly mounted to carriage assembly 52 by shafts 54 and 61, do experience linear reciprocating movement under the control of piston assembly 50. Downward movement from the uppermost position shown in FIG. 1a is accomplished by inserting air under pressure into one of the inlet ports in the upper end 50a of the air cylinder to drive the piston and hence the carriage diagonally downward. Thus, as the pulleys 56a, 56b and 57a, 57b move downwardly to slacken the O-ring belts, the pulleys 62a, 62b and 63a, 63b simultaneously move downwardly a corresponding amount so as to maintain the O-ring belts 82a–82d substantially taut. The intervening non-reciprocating pulleys (for example, pulleys 64a, 73a, 80a and 76a) aid in maintaining appropriate tension in the O-ring belts and also assure smooth transitional movement of the O-rings as the carriage 52 is moved. The carriage assembly moves to its downward most position, shown in dotted line fashion, wherein the carriage roller 62a, for example, moves to the position 62a' (see FIG. 1a) so as to extend at least partially into the gap formed as a result of the movement of signatures S' and S'' about the pulley 16. In this position, the folded edge F' of Signature S'' is diverted upwardly along the O-ring belts 82a–82d so as to move between the upper run 82a-4 of the movable conveyor belt and the lower run of stationary conveyor belts 40 entrained about rollers 41, 42 and 41', 42' and lower pulleys 34, 36 and 34', 36''. The signature is moved upwardly therealong and is hence diverted from the main delivery path. The linear rate of travel of the aforementioned confronting runs of the movable and stationary conveyor belt assemblies, as determined by motor M, is preferably of the order of three times the linear rate of movement of conveyor belts in the main delivery path so as to rapidly move a signature between these confronting runs and hence rapidly extract the signature from the main delivery path. The time period during which the carriage assembly remains in the lower-most (intercept) position is determined by the number of signatures to be extracted from the main delivery path and can be as brief a time interval as is required to extract as few as just one signature from the main delivery path. In order to rapidly remove the carriage assembly from the intercept position, air under pressure is admitted into one of the ports provided at the lower end 50*b* of air cylinder 50 to permit very rapid movement of the carriage assembly away from the intercept position.

The U-shaped portion 53 of carriage assembly 52 is provided with a permanent magnet member 90 secured along the outer side of arm 53*b* (see FIG. 1*d* and 3). This magnet member cooperates with a magnetic sensor 91 (FIG. 1*b*) mounted at the inner end of tubular member 92 having a support bracket 93 for mounting magnetic sensor 91 and provided with a support plate 94 at its opposite end for securing member 92 to plate 25. This magnetic sensor is utilized to develop a pulse for rapidly resetting the piston and hence the carriage assembly preparatory to the next extraction operation in a manner to be more fully described.

Figure 2A:
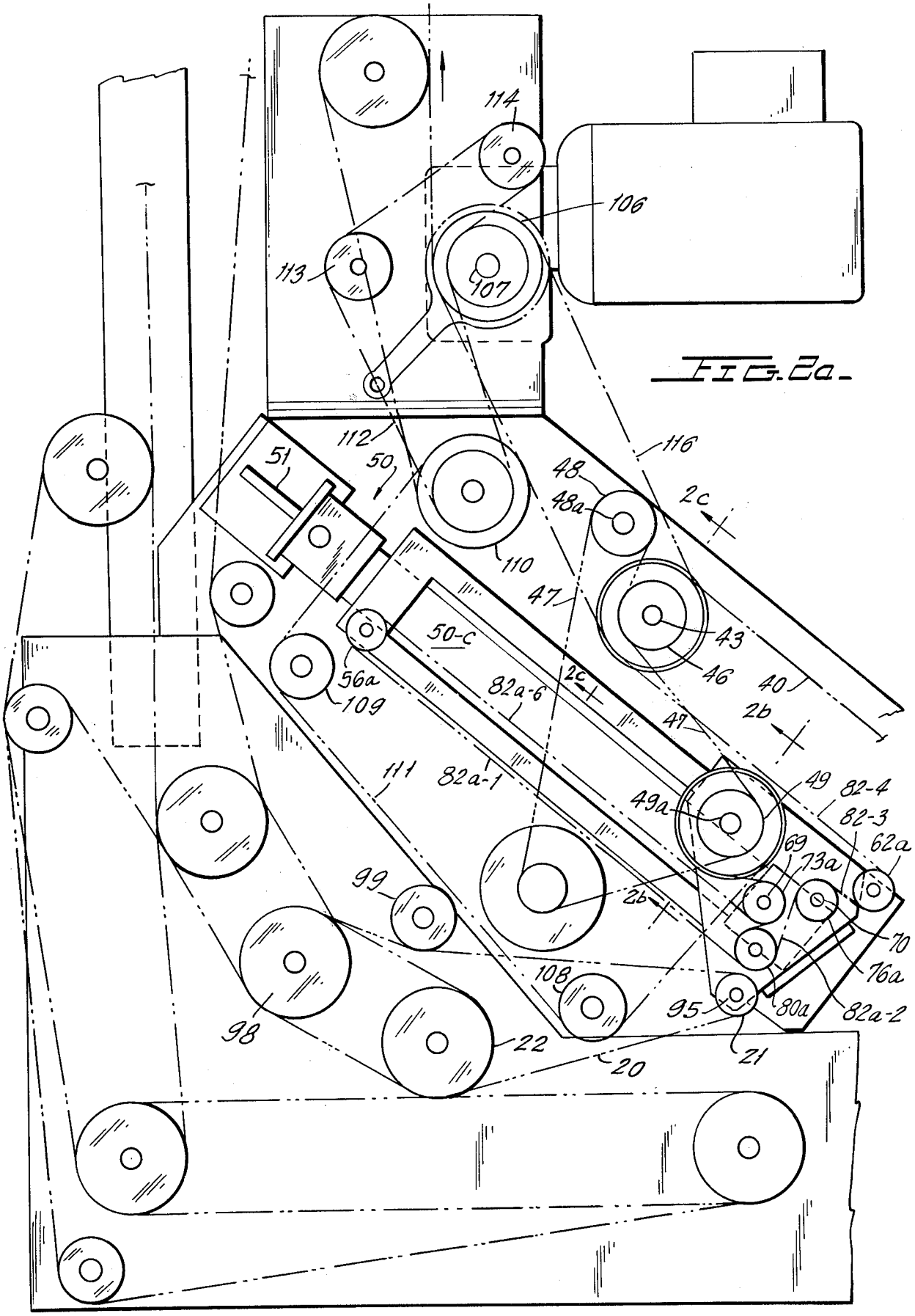
Figure 2B:
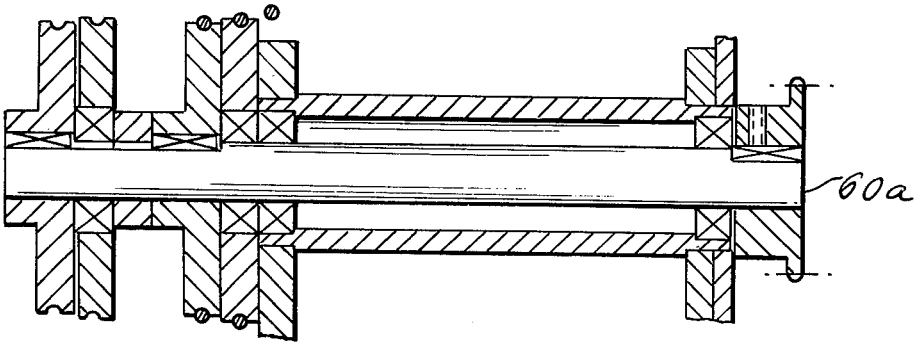

FIG. 2*a* shows some additional conveyor belt assemblies which cooperate with both the main delivery path and the extractor delivery path. Noting FIGS. 1*a* and 1*b* in conjunction with FIG. 2*a*, it can be seen that the support plates 63 and 68 support a shaft 95 upon which rollers 21*a*–21*d* are freewheelingly mounted. Each of these rollers has entrained therearound a resilient O-ring belt 20 which is further entrained about associated rollers 22, 98 and 99. The lower run of O-ring belts 20 extending between rollers 21 and 22 cooperate with belts 18 to form a tapered infeed path for again placing the signatures which are passed over the "bend" formed about rollers 16 under compression for the reasons set forth hereinabove.

Figure 2C:
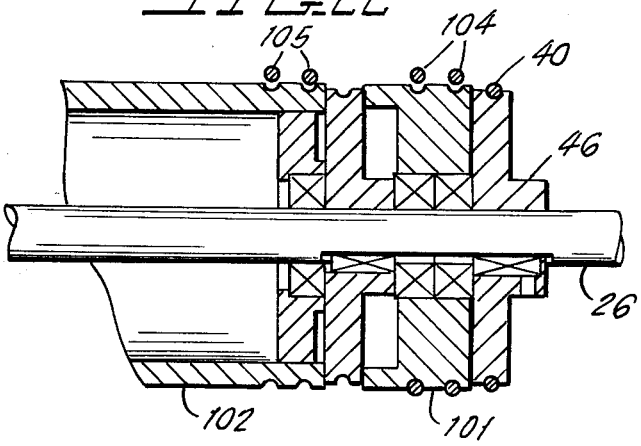

The shaft 43 is further provided with rollers 101 and 102 along the right-hand side (see FIG. 2*c*) which are freewheelingly mounted upon shaft 43 and which are grooved about their peripheries so as to receive the O-ring belts 104 and 105 entrained about pulleys 101, 102 and associated pulleys 106 mounted upon shaft 107.

A similar pulley arrangement is provided on shafts 49*a* and 65 (see FIG. 1*b*) and is adapted to cooperate with associated pulleys 108, 109 and 110 for receiving and supporting resilent O-ring belts 111 entrained thereabout and defining a substantially rectangular closed loop path having one run extending between pulleys 110 and the pulleys on shaft 43 and cooperating with the O-ring belts 40 of the stationary conveyor assembly to guide extracted signatures in the upward direction. Still another O-ring belt arrangement comprised of O-ring belts 112 entrained about alternating ones of the pulleys 110 and pulleys 113 and 114, defines a substantially L-shaped belt arrangement which cooperates with the O-ring belts 116 to further move the extracted signatures substantially diagonally upward to the left and then about rollers 106 so as to sharply move the extracted signatures diagonally upward and to the right as they move about pulleys 106, whereupon extracted signatures are removed from the extractor assembly.

The main delivery path has a signature counter 120 positioned a predetermined distance upstream from the pulley 16 as shown in FIG. 1*a* and is utilized to sense the leading edges of signatures and generate a pulse for each signature as they pass between the lower run of belts 37 and the upper run of belts 14 and beneath sensor 120. This sensor may be of the type described in U.S. Pat. No. 3,702,925.

Figure 5:
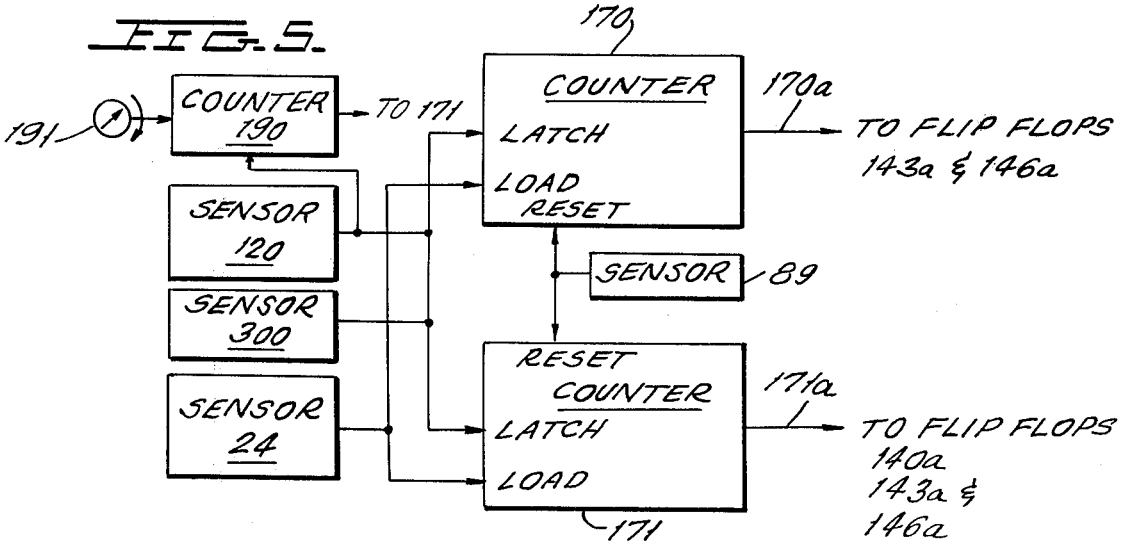

FIG. 5 shows a schematic diagram of the pneumatic circuit for the extractor assembly. The piston assembly 50 shown therein in simplified fashion, is provided at its upper end 50*a* with an inlet port 50*e* and is provided at its lower end with inlet port 50*f* and an exhaust port 50*g*. Piston P divides the cylinder into "Side 1" and "Side 2" air chambers. A compressed air source 130 is shown as being coupled through a conduit 131 to a regulating valve 132, which regulates the pressure in conduit 131. A meter 133 is provided in the pneumatic circuit for visually monitoring the pressure therein. Conduit 134 is coupled to common conduit 135 having conduit branches 136 through 139 coupled thereto. Conduit 136 is selectively coupled to inlet port 50*e* through solenoid operated valve 140. Conduit 137 is selectively coupled through solenoid operated valve 141 to inlet port 50*f*. Conduit 138 is selectively coupled through relief valve 142 and solenoid operated valve 143 to inlet port 150. A meter 144 provides for visual observance of the pressure of conduit 138. Conduit 139 is selectively coupled through solenoid control valve 143 to inlet 50*f*. The outlet port 50*g* is selectively coupled to an exhaust conduit 145 through solenoid controlled valve 146. Each valve is biased by an associated spring Sp to the valve position shown in the "box" aligned with its associated conduits when the solenoid is deenergized. When the solenoids are energized, their associated valves assume the position shown in the remaining box shown displaced from its associated conduits. For example, considering solenoid controlled valve 141, when the solenoid is deenergized the spring Sp causes the valve to be closed, i.e. prevents air under pressure from passing through conduit 137 and valve 141 to enter piston assembly inlet 50*f*. When the solenoid is energized, the valve is opened to permit air under pressure to pass through conduit 137 and open valve 141 into inlet 50*f*. Each solenoid is activated by a bistable circuit, such as a flip-flop, which maintains the proper operating state until set (or reset).

Figure 4:
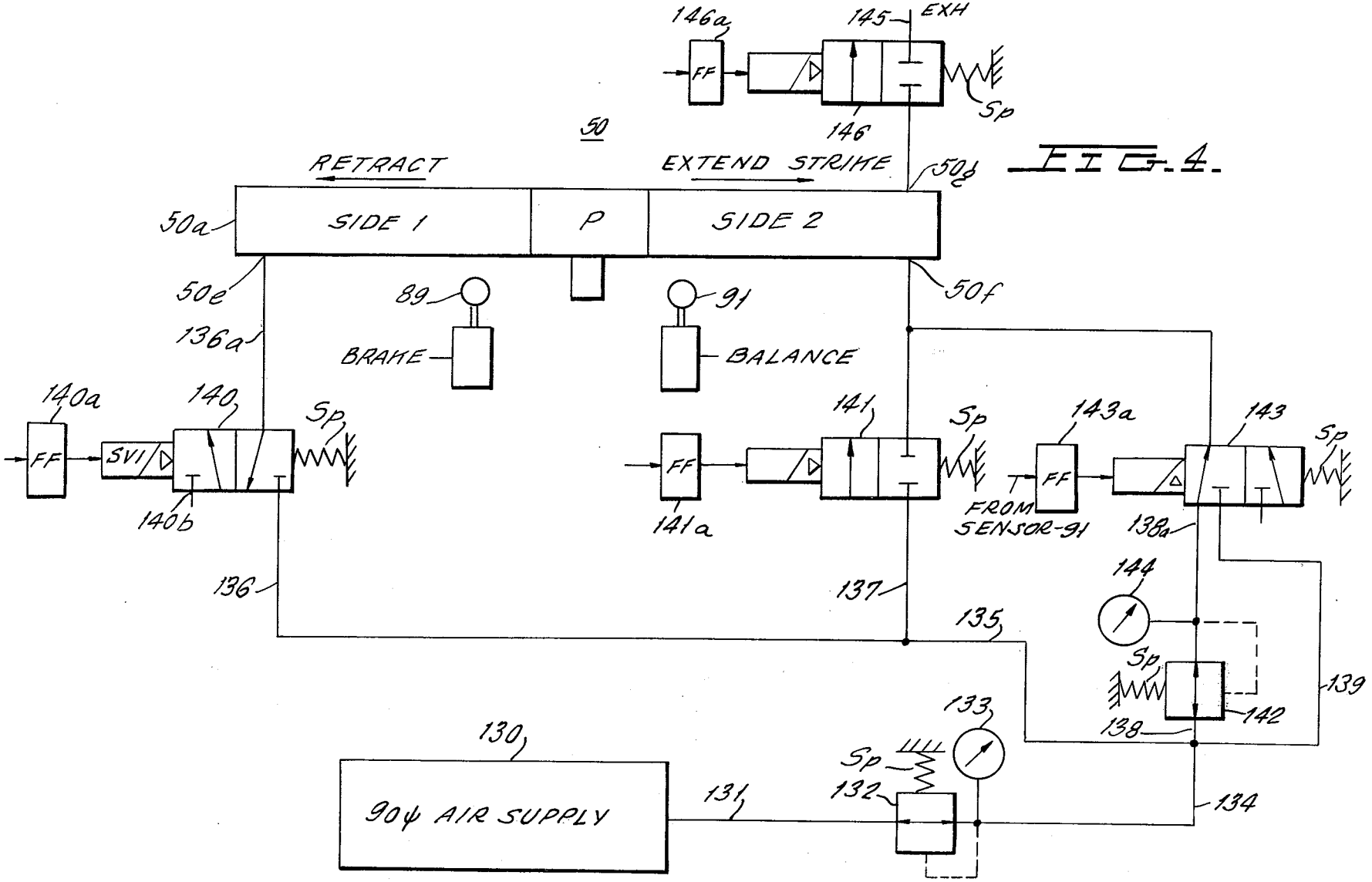
FIG. 4 shows a schematic diagram of the pneumatic circuit employed in the extractor of FIG 1*a;*
Figure 5:
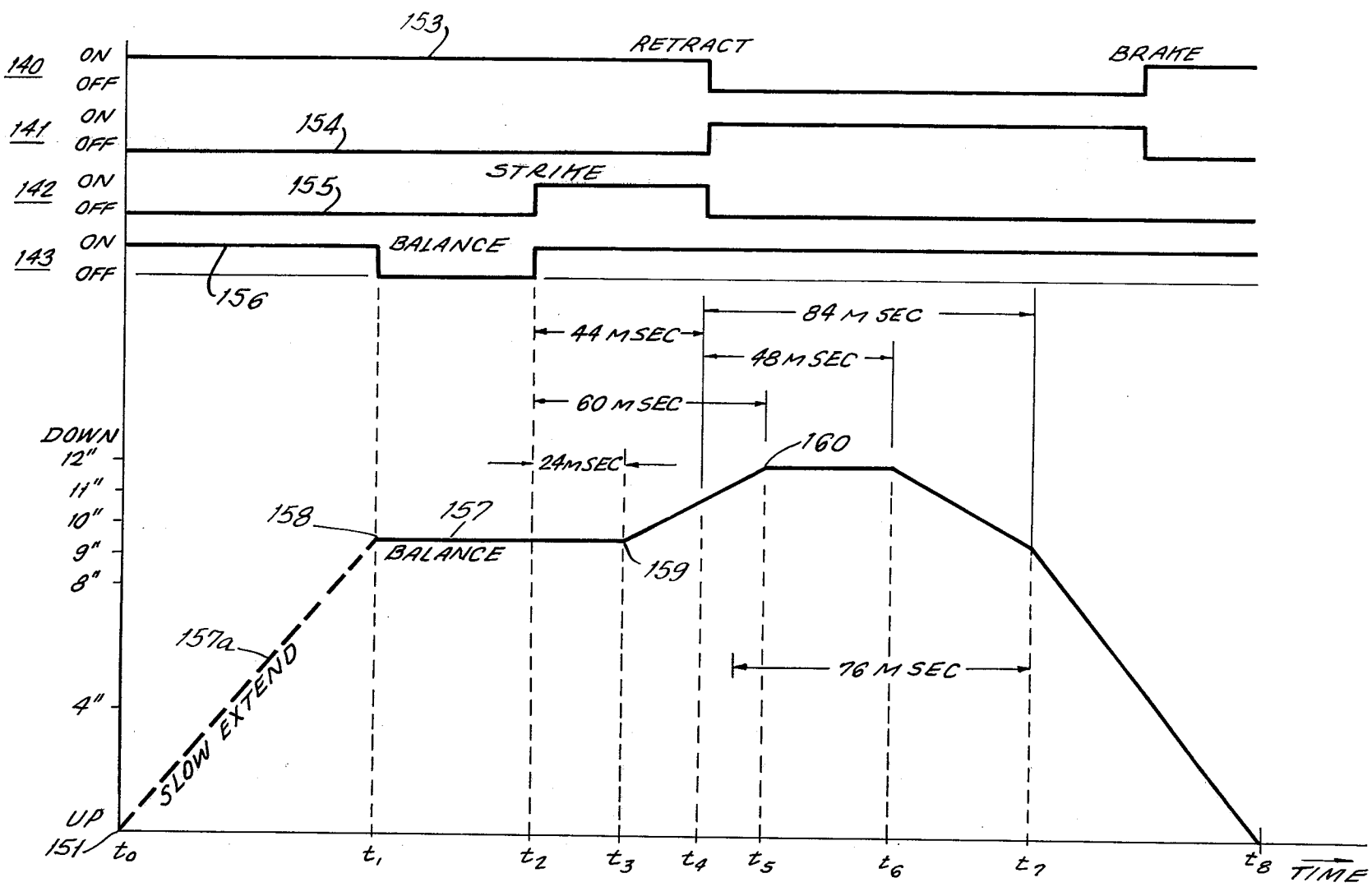

The manner of operation of the extractor assembly will now be considered in conjunction with FIGS. 4, 5 and 6, FIG. 6 showing graphically the manner of operation of the valves and the movement of the carriage 50.

Let it be assumed that the movable conveyor assembly is at its upper-most position. At this time, the lower end of the movable conveyor assembly, as represented by pulleys 62*a*, 62*b* and 63*a*, 63*b* occupies the location represented by point 151 along curve 152. At this time, $t_s$ solenoid controlled valves 140 and 143 have their flip-flops 140*a* and 143*a* set so that their solenoids are energized. Solenoid controlled valves 141 and 146 are deenergized. These states are represented by waveforms 153, 156 and 154, 155 respectively.

The energization of solenoid controlled valve 140 couples the air pressure source 130 through conduits 131, 134, 135, 136, open valve 140 and conduit 136*a* to inlet port 50*e*. Energized solenoid controlled valve 143 couples port 50*f* to conduit 138*a* and regulator 142, allowing air from Side 2 to be slowly exhausted through regulator 142 due to the air pressure applied thereto by conduits 134 and 138. Since solenoid controlled valves 141 and 146 are closed, air under pressure in conduit 137 is prevented from entering into inlet port 50*f* through 141 and the air in "Side 2" chamber is prevented from exiting through outlet ports 50*f* (through valve 141) and 50*g* (through valve 146). Thus, the carriage slowly extends towards the "balanced" position.

Since the pressure in Side 1 is higher than in Side 2, the piston is forced down and the air in Side 2 escapes under pressure through port 50*f* and through valve 143, through conduit 138*a* and through regulator 142 which is calibrated to have a slightly lower pressure than regulator 132 to atmosphere. The carriage assembly 52 is thus permitted to experience a "slow" extend operation moving along the dotted line portion 157*a* of curve 157. As the magnet member 90 moves into alignment with magnetic sensor 91 (see FIGS. 4 and 1*b*), which is caused to develop an output signal which serves to reset FF 143*a* in order to deenergize solenoid controlled valve 143. This occurs at time $t_1$. The carriage thus moves to point 158 along curve 157 and the equalized pressure as between "Side 1" and "Side 2" of piston P prevents any further movement of the carriage assembly 52 from the "balanced" position.

Let it be assumed that at time $t_2$ it is desired to perform an extraction operation. At this time solenoid controlled valves 140, 146 and 143 are energized and 141 is deenergized. The energization of solenoid controlled valve 143 continues to permit air under pressure to leave Side 2 of the piston assembly through regulator 142 and at the same time air is permitted to be rapidly exhausted through port 50*g* and open valve 146 to pass through the exhaust conduit 145. The air pressure passing through valve 140 into port 50*e*, coupled with the air exiting from ports 50*f* and 50*g*, rapidly drives the piston P, and hence the carriage 52, towards the intercept position. The inertia of the movable components and the operating time of the solenoids is such as to cause the extractor assembly to experience a delay between the time the signals controlling the valve solenoids are generated and the time that the carriage actually starts to move and finally arrives at the intercept position. As shown in FIG. 6, the delay is of the order of 24 milliseconds between the time $t_2$ when the strike signal is generated and time $t_3$ when carriage 52 begins moving downwardly toward the intercept position thereby moving from point 159 along curve 157 to point 160 along curve 157 and arriving at the intercept position at time $t_5$. The elapsed time between the energization of solenoid controlled valves 146 and 143 ($t_2$) and the time at which the carriage arrives at the intercept position ($t_5$) is of the order of 60 milliseconds. The distance moved in this time interval is of the order of 2.5 inches. Thus the movable conveyor assembly has moved from the "balanced" position to the intercept position at an average velocity of the order of 3.5 feet per second.

In the example of FIG. 6, it can be seen that the retraction of the movable conveyor assembly is initiated at time $t_4$ which occurs of the order of 16 milliseconds prior to the time ($t_5$) at which the carriage assembly reaches the intercept position. A delay of the order of 48 milliseconds occurs before the carriage assembly arrives at the intercept position and then begins to retract from the intercept position ($t_5$). It can be seen that the time interval between the generation of the retraction signals ($t_4$) until the time ($t_6$) that the carriage assembly 52 begins to move, is of the order of 48 milliseconds, which delay period is due to inertia of the extractor assembly movable elements and the operating time for the solenoid controlled valves which are activated at this time as well as the time between opening or closing of the valves and the build up (and/or decay) of air pressure.

Returning to the time ($t_4$) at which the retract operation is initiated, solenoid controlled valves 140 and 146 are deenergized while solenoid controlled valves 141 and 143 are energized. The deenergization of solenoid controlled valve 140 couples port 50*e* on Side 1 of piston P to the outlet port 140*b* allowing air from Side 1 to be exhausted therethrough. The energization of valve 141 couples air under pressure from source 130, conduits 131, 134, 135 and 137 and open valve 141 to inlet port 50*f*. The closure of valve 146 prevents the exiting of any air through exhaust port 145 while the continued energization of valve 143 couples air under pressure from regulator 142 through open valve 143 and into port 50*f*. As a result, the piston P, and hence the carriage 52, are rapidly moved toward the retract position.

As was described hereinabove, when the lower end of the movable conveyor assembly is in the intercept position, as represented by pulley 62*a*′ of FIG. 1*a*, the signature S″ is diverted from the main delivery path upwardly along the run 82*a*–4′ between pulley 62*a*′ and pulley 64*a* until it is caught between O-ring belts 82*a*–82*d* and O-ring belts 40 at which time the signature is rapidly moved upwardly and away from the main delivery path. The retracting movement of the carriage assembly 52 and hence the movable conveyor assembly is sufficiently rapid so as not to interfere with the normal movement of the next upstream signature adjacent to the signature S″ permitting this signature to continue unimpeded movement along the main delivery path.

As the carriage assembly moves upwardly towards its upper-most position, the permanent magnet member 90 passes a second magnetic sensor 89 mounted upon the free end of a support 89*a* whose opposite end is secured to side plate 25 (see FIG. 1*b*). As the permanent magnet member 90 passes sensor 89, the sensor develops a pulse which causes solenoid controlled valves 140 and 141 to be respectively energized and deenergized through FF 140*a* and 141*a*, respectively, causing air under pressure to pass through open valve 140 into port 50*e* and to close valve 141 to prevent air from entering into port 50*e* thereby rapidly decelerating and hence resetting the carriage assembly and hence the movable conveyor assembly to the balanced condition in readiness for the next extraction operation.

In order to extract one, two, several or many signatures from the main delivery path, sensor 120 shown in FIG. 1*a* is utilized to detect the next leading edge of a signature when a start signal is given or start button is depressed and, at this time sensor 120 generates a pulse which unlatches counters 170 and 171 shown in FIG. 5*a*. The counters are thus enabled to accumulate pulses derived from magnetic sensor 24 which generates a pulse as each tooth of the gear 23 shown in FIG. 1*a* passes the magnetic sensor, which pulses are simultaneously accumulated by now unlatched counters 170 and 171. Counters 170 and 171 are adapted to generate signals at their outputs 170*a* and 171*a* upon reaching predetermined counts. Each pulse represents linear movement of a signature over a distance of 0.20 inches. Counter 171 is adapted to accumulate a larger predetermined count than counter 170. The rate of accumulation of pulses is determined by the velocity of the signature stream in the main delivery path and hence the velocity of the belts delivering signatures therealong.

In order for the extractor to effectively remove one or a predetermined number of signatures from the conveyor stream, it is necessary to carefully time the action of the extractor carriage with the position of the signatures moving along the conveyor belts. In order to implement the logic necessary to control this operation it is necessary to have a newspaper sensor mounted on the stream and also a speed/distance sensor. With this in mind the operation of the logic is as follows.

Assume that the conveyor is running and newspapers are lying on the conveyor belts. These newspapers are being conveyed to the mailroom. As the newspapers pass under the sensor each paper produces an output pulse which is sensed by the extractor control, and in addition the speed/distance sensor is applying pulses to the extractor control logic. At a given time the extract pushbutton is depressed and immediately thereafter the extractor assembly moves down into the conveyor stream to intercept the signature. The process which actually occurs during this interval of time is explained as follows. Once the extract pushbutton has been depressed the logic is primed to wait for the next paper to pass underneath the sensor. When this occurs a pulse is picked up by the extractor control and sets up circuitry for the strike delay. This logic will cause a counter to commence counting (i.e. tracking) the newspaper that has just passed beneath the sensor to the point where the strike extractor arm will meet the paper and remove it from the stream. In order to effectively remove this newspaper from the stream, two considerations must be given. (1) The distance from the sensor to the point in which the extractor arm meets the paper and (2) the mechanical delay of the extractor carriage itself in responding to the signal to strike. The first of these considerations, that is the distance from the sensor to the strike point, is controlled by counting the number of gear teeth of gear 23 passing the speed/distance magnetic sensor 24 as the paper passes from the sensor point towards the strike point. A strike delay counter set to a number equal to this number of gear teeth would then provide an output to the strike mechanism when the paper has traveled the distance from the sensor to the strike zone. If there were no mechanical delay of the strike assembly this logic would provide the necessary function to cause the paper to be extracted from the stream. However, in actual practice the mechanical delay of the extractor mechanism would cause the extractor to miss the paper intended to be extracted unless the conveyor were moving at extremely slow speeds making the mechanical delay of the extractor an insignificant portion of the total time allotted for the extraction procedure. In actual operation the mechanical delay of the extractor is significant and must be compensated for in order to successfully remove newspaper from the stream. A very slow speeds very little compensation is needed since the mechanical delay is a small portion of the total operating time. However, as the speed of the press increases the time becomes effectively a greater portion of the entire cycle and must be compensated for linearly as the press increases. This is accomplished by adding a circuit in the control that causes the output from the strike delay counter to progressively occur sooner as the press speed increases and in doing so causes the output to the extractor arm to be generated prematurely with sufficient time allotted for the mechanical delay so that the extractor mechanism still strikes in the proper zone when the paper has reached that area. A similar compensation must be allowed when retracting the extractor mechanism.

In order to remove only the proper number of news copies from the stream it is necessary to remove the extracting mechanism from the stream at the proper time so as not to catch an unwanted paper while it is in the strike zone. To do this a process very similar to the strike delay is employed where at a given time a newspaper passing under the newspaper sensor is decided that it will be the last paper to be removed from the stream. Once this decision has been made, logic counter 171 will start counting the speed distance pulses and at a given time produce an output pulse which causes the extractor to remove itself from the strike zone. This motion must also be compensated for the mechanical delay and in a similar fashion to that described hereinabove for the strike delay circuitry. In summary, then it can be said that the control performs the following function. (1) At a given time, begin tracking a selected paper from the newspaper sensor location to the strike zone causing the extractor mechanism to meet the paper at this point and remove it from the stream. One method for accomplishing this is to track the newspaper from the point of counting (i.e. sensor 120) to the point of interception and to compensate for the mechanical delay inherent in the extractor mechanism. Similarly, at a given time later when the last paper to be extracted is removed from the stream this selected paper will have to be tracked from the point of counting to the point of interception again and at that time with compensation allowed for mechanical delay the extractor mechanism removed from the stream.

The number of pulses accumulated by counter 170 upon reaching the predetermined count represents the linear distance between the location of sensor 120 and the intercept position. Thus if the distance of sensor 120 and the intercept position is 10 inches, counter 170 should accumulate 50 pulses (50 pulses × 0.20″). Since the predetermined count of counter 170 must be reached before the signature to be extracted reaches the intercept position, due to the mechanical delays inherent in the operation of the solenoids 140, 141, 143 and 146, the piston assembly 50 and the movable carriage 52, the predetermined count must be reached early enough to cause the carriage 52 to move into the intercept position as the signature to be extracted reaches the "gap". If desired, the output pulses from sensor 24 may alternatively be adapted to be doubled in order to generate two pulses per tooth to double the rate of accumulation of pulses by the counter for a time interval exactly equal to the time between the initiation of the strike signal and the time the carriage assembly is in the extract position. For example, it takes 60 milliseconds between $t2$–$t5$ which is the mechanical delay. The apparatus electronically doubling up the pulses from 24 before they are fed into counter 170 for exactly 60 milliseconds. That will exactly compensate for the mechanical delay and move the strike signal ahead the number of pulses occurring in 60 milliseconds × 0.20″ so that the predetermined count is reached before the signature to be extracted reaches the "gap" and so that the carriage will be in the intercept position at the required moment. As another approach, the predetermined count may be selected to be reached when the signature to be extracted has moved downstream relative to sensor 120 (FIG. 1*a*) but before it reaches the intercept position.

Since gear 23 is rotated by belts 18, the angular speed of gear 23 determines the rate of generation pulses of sensor 24. The time interval required for counter 170 to reach its predetermined count is determined by time required for the forward folded edge of a signature to move from beneath sensor 120 to the intercept position. Counter 170 accumulates an additional number of pulses sufficient to enable the signature to be extracted to move over an additional linear distance of the order of 3 inches. As soon as counter 170 reaches its predetermined count, its output signal is utilized to energize the flip-flops 143*a*–146*a* of solenoid controlled valves 143 and 146 (for example, at time $t_2$ as shown in FIG. 6) to rapidly move the carriage assembly from the "balanced" position to the intercept position. As soon as counter 171 reaches its predetermined count which, as described hereinabove, is greater than the predetermined count of counter 170, its output is coupled to solenoid controlled valves 140, 141 and 146 to rapidly extract the carriage assembly from the intercept position.

As the carriage assembly is being extracted and its magnetic member 90 moves past sensor 89, the sensor is utilized to generate a pulse which resets and clears counters 170 and 171 in addition to returning the extractor assembly to the "balanced" position.

The double counter arrangement may be utilized with an additional counter 190 to extract any number of signatures and by providing suitable manually operable control means 191, the predetermined count in counter 190 may be suitably adjusted to extract 1, 2, or some small or large predetermined count of signatures. The extractor is thus synchronized with the velocity of the signature stream in order to precisely extract the desired signature or signatures from the main delivery path.

The number of signatures to be extracted are counted by counter 190 which is stepped by sensor 120. On the first count, counter 170 is enabled to receive pulses from sensor 24. When the predetermined count is reached, the extractor is activated to intercept the stream. When the count of the number of signatures to be extracted is reached, counter 171 is activated by counter 190 and counts out when the extractor should be activated to be withdrawn from the stream. When extracting more than one signature, the output of sensor 120 is disconnected from counter 171.

In order to extract "paster" copies, a paster copy is identified by placing a strip of reflected tape on the upper surface of the signature. Sensor 300 (see FIG. 1*a*) is provided to detect the presence of a "paster" copy and is provided with a light source 301 and a photodetector 302. When a piece of reflective tape is present the light from source 301 is reflected therefrom and is sensed by photodector 302. The threshold level of the photodetector is selected to enable the photodetector to respond to the presence of the reflective tape but is set to a high enough threshold level to prevent the photodetector from being activated by light reflected from the signature. Although FIG. 1*a* shows the sensor 300 as being located downstream relative to sensor 120, it should be understood that sensor 300 should normally be positioned approximately 5–20" ahead of the sensor 120 so that the counters 170 and 171 will operate in the indentical manner to that described hereinabove when activated (i.e., unlatched) by sensor 120.

When the reflective tape is detected the counters 170 and 171 are unlatched and begin to accumulate pulses derived from sensor 24. The operation is otherwise identical to that described hereinabove when under control of sensor 120.

It can therefore be seen from the foregoing description that the present invention provides a novel extractor assembly of extremely low mass and hence low inertia as compared with conventional extractor devices and which is capable of extracting one, several or any number of signatures from a main delivery path wherein the extremely low mass of the movable conveyor assembly in the extractor permits removal of as few as one signature from the main delivery path without interfering with the normal flow of signatures along the main delivery path and wherein the time required for extracting a paper from the signature stream is a function of the feed velocity of the signature stream as monitored by the sensor device 24.

What is claimed is:

1. A method for separating at least one signature from a stream of signatures moving in a forward feed direction from an upstream location along a conveying path having a main path and a branch path selectively movable towards the main path for conveying a stream of signatures, weekly journals, brochures or the like, which are arranged in overlapping fashion and have spines facing forward and in the downstream direction of the main path, said signatures each having a bottom and a top surface whereby each bottom surface engages the top surface of the preceding adjacent downstream signature and each top surface engages the bottom surface of the succeeding adjacent upstream signature, the spines of each signature being a spaced distance from the spines of adjacent upstream and downstream signatures, the branch path being provided with a stationary and a reciprocating shunting devices as well as a withdrawing device having engaging belts, the method of comprising the steps of:

leading the signatures around a bend so that the spine of each signature is caused to lift away from the engaging top surface of the preceding adjacent downstream signature to form a gap between the lifted spine and the top surface of the preceding adjacent downstream signature;

moving the reciprocating shunting device into said gap whereby the lifted spine is deflected towards and along the withdrawing device and between the engaging belts; and rapidly withdrawing the reciprocating shunting device away from said gap as the deflected signature moves between the engaging belts by means of a quick backward snatching of the withdrawing device while the extracted signature continues to move between the belts of the withdrawing device.

2. Apparatus for withdrawing at least one signature from a signature stream moving from an upstream location in a downstream direction and in which signatures are arranged in overlapping fashion, each signature having a spine facing in the downstream direction, said signatures each having top and bottom surfaces, whereby each bottom surface engages the top surface of the preceding adjacent downstream signature and each top surface engages the bottom surface of the succeeding adjacent upstream signature, the spines of each signature being a spaced distance from the spines of adjacent upstream and downstream signatures comprising:

means for conveying said signature stream in the downstream direction along a main delivery path;

means in said main path for leading the signatures around a bend to lift the spine of each signature away from the engaging top surface of the preceding downstream signature and to form a gap therebetween;

a shunting device for deflecting signatures away from the main path and along a branch path, said device comprising:

a reciprocally mounted carriage;

first closed loop conveyor belt means entrained about a first lower and a second upper pulley rotatably mounted on said carriage for movement in a first direction;

second closed loop conveyor belt means entrained about a third lower and fourth upper pulley rotatably mounted adjacent to said carriage;

a portion of said second belt means extending between said third and fourth pulleys engaging a portion of the first belt means extending between said first and second pulleys;

said engaging belt portions defining said branch path;

means for moving the engaging portions of said first and second belts in a first direction along said branch path;

means for abruptly reciprocally moving said carriage along said branch path and towards said main path to position said first pulley in said gap and for moving said carriage away from said main path to remove said first pulley from said gap whereby the signature whose spine is lifted at said bend is deflected towards said branch path and between the engaging portions of said belts when said first pulley lies in said gap and the deflected signature passes between the engaging belt portions as the carriage moves the first pulley away from said gap thereby enabling signatures not deflected by the first pulley to continue moving along said main path.

3. A conveying path with a main path and a branch path optionally engageable and alignable with the main path for conveying a stream of signatures, weekly journals, brochures or the like, which overlap each other having their spines facing forward in the conveying direction, the main path having a crest arranged to accomplish a separation of the signatures in the area at the crest so that a shunting device, movable between two end positions, is introducible in a gap formed between two adjacent signatures, when the downstream signature bends over the crest, characterized in that the branch path is defined by a carrier which is reciprocally displaceable in a sloping plane relative to said main path and between an upper and a lower end position, said carrier supporting lower first endless driven belt conveyor means with a number of endless belts running over pulleys, said endless belts entrained about a first lower and a second upper pulley, a second conveyor means adjacent said carrier and having endless belts entrained about a third lower and a fourth upper pulley and having a portion of said belts lying adjacent belts of said first conveyor means for conveying signatures between the belts of said first and second conveyor means; the third pulley of said second conveyor means being positioned above the first pulley of the first conveyor means when the first conveyor means is moved to the lower end position so that the belts of the first conveyor means have a lower end portion for guiding in at least one signature under the third pulley of said second conveyor means when the carrier is in its lower end position, and the first pulley of the first conveyor means lies in said gap.

4. The conveying path according to claim 3, characterized in that said first conveyor means further comprises a plurality of pulleys rotatably mounted upon stationary shafts positioned intermediate said first and second pulleys, said intermediate pulleys of the first conveyor means being driveably united with one of the pulleys of the second conveyor means, for driving both of the conveyors at the same velocity.

5. The conveying path according to claim 4, characterized in that the one pulley of the first conveyor means is supported by a shaft and connected with a driving motor for moving the belts of the first conveyor means a velocity which is greater than the velocity of the signatures moving along the main delivery path.

6. Apparatus for extracting a predetermined number of signatures from a stream of overlapping signatures moving along a main delivery path; said main path comprising:

main delivery means for moving signatures, weekly journals, brochures or the like along the main delivery path, which signatures are arranged in overlapping fashion and have spines facing forward and in the downstream direction of the main delivery path, said signatures each having a bottom and a top surface whereby each bottom surface engages the top surface of the preceding adjacent downstream signature and each top surface engages the bottom surface of the succeeding adjacent upstream signature, the spines of each signature being a spaced distance from the spines of adjacent upstream and downstream signatures;

said main delivery means including means for leading the signatures around a bend to lift the spine of an upstream signature passing said bend away from the engaging top surface of the next adjacent downstream signature to form a gap therebetween;

first stationary conveyor means comprising lower and upper rotatable pulleys and first belt means entrained about said pulleys, the lower pulley being positioned above said bend;

second movable conveyor means comprising:

an elongated carriage;

means for reciprocally moving said carriage between an extracted position and an intercept position and having first and second rotatable pulleys respectively mounted to upper and lower ends of said carriage;

second belt means being entrained about said first and second pulleys;

said second pulley being positioned in said gap when said carriage is moved to the intercept position;

said first and second belt means having confronting portions defining a branch path;

means for relatively moving said first and second belt means so that said confronting portions move a signature therebetween at a velocity which is greater than the velocity of signatures moving along the main delivery path;

said carriage means being abruptly moved towards the extracted position when a requisite number of signatures has been extracted from the main delivery path.

7. The apparatus of claim 6 further comprising means for sensing the movement of said carriage towards said intercept position to cause said moving means to halt said carriage at a ready position intermediate said retracted and intercept positions in readiness for an extraction operation.

8. The apparatus of claim 6 further comprising means for sensing the movement of said carriage towards said retracted position to cause said moving means to halt said carriage before reaching said retracted position.

9. The apparatus of claim 6 wherein extraction of "marked" signatures is performed by placing a piece of reflective material on a marked signature;

sensing means positioned upstream relative to said bend for sensing the presence of said reflective material to generate a control signal;

means responsive to said control signal for generating first and second delayed control signals;

said moving means being responsive to said first delayed control signal for moving said carriage towards said intercept position so that the lower pulley arrives at said intercept position at the same time that the "marked" signature defines the upper signature of said gap and responsive to said second delayed control signal for moving said carriage towards the retracted position whereby only the "marked" signature is extracted from the main delivery path.

10. The apparatus of claim 6 further comprising means for extracting signatures "marked" by a reflective strip comprising a light source for directing light towards said signature stream;

photodetector sensing means for sensing light reflected from said signatures, said sensing means including threshold means for producing an output signal only when light is reflected from said reflective tape, control means responsive to said output signal for activating said moving means to move said carriage into the intercept position when the "marked" signature arrives at the intercept position;

said control means further including means for activating said moving means to move towards the extracted position a predetermined time after movement to the intercept position in order to remove only said "marked" signature from the main path without interfering with the normal flow of signatures along said main path.

11. The apparatus of claim 6 wherein said movable conveyor means further comprises a plurality of pulleys rotatably mounted upon stationary shafts positioned intermediate said first and second pulleys;

said first belt means being further entrained about said plurality of pulleys whereby said plurality of pulleys cooperate with said upper and lower pulleys to cause said first belt means to experience a smooth transition when moved by said carriage.

12. The apparatus of claim 11 wherein said means for moving said first and second belt means comprises motor drive means and means for coupling said drive means to one of said plurality of pulleys.

13. The apparatus of claim 12 wherein said moving means further comprises means for coupling said drive means to one of said first and second pulleys.

14. The apparatus of claim 6 wherein said carriage moving means comprises an elongated piston drive means having a reciprocating piston and a member coupled between said piston and said carriage for moving said carriage.

15. The apparatus of claim 14 wherein said moving means further comprises:

a pressure source;

said piston assembly having first and second ports at its lower end and a third port at the upper end;

first and second valve means for selectively coupling said pressure source respectively to said first and third ports and third valve means for selectively coupling said second port to an exhaust conduit;

said first and second valve means being respectively opened and closed to move said carriage towards the intercept position and being respectively closed and open to move said carriage towards the extracted position.

16. The apparatus of claim 15 further comprising means for sensing movement of the carriage towards said intercept position for opening said second valve means to halt said piston and retain said carriage in a ready position a spaced distance from said intercept position in readiness for an extraction operation.

17. The apparatus of claim 15 further comprising sensing means for sensing the movement of said carriage towards said retracted position to open said first valve means and halt said carriage before arriving at the extracted position.

18. The apparatus of claim 6 further comprising first sensing means for monitoring the velocity of signatures in said main delivery path and for generating pulses at a rate representative of said velocity;

means positioned upstream of said bend for detecting the passage of signatures;

first and second counter means being incremented by pulses from said monitoring means;

said first and second counter means each including means for respectively generating first and second control signals upon reaching first and second predetermined counts, said second count being greater than said first count;

said moving means being responsive to said first control signal for moving said carriage towards said intercept position and being responsive to said second control signal for moving said carriage towards said extracted position.

19. The apparatus of claim 18 wherein said first counter means includes means for adjusting said first predetermined count in accordance with the velocity of signatures moving along the main delivery path.

20. The apparatus of claim 19 wherein said second counter means includes means for adjusting said second predetermined count wherein the difference D between said first and second predetermined counts $C_1$ and $C_2$ is given by $C_2=D+C_1$ and $D=dN$, wherein $N$ is a real integer and $d$ is the minimum difference for extracting a single signature from said main delivery path.

* * * * *